US006528710B2

(12) United States Patent
Steinberger

(10) Patent No.: US 6,528,710 B2
(45) Date of Patent: Mar. 4, 2003

(54) STRING CLAMPING AND TUNING SYSTEM FOR MUSICAL INSTRUMENT

(76) Inventor: Richard Ned Steinberger, 420 Hill Top Rd., Nobleboro, ME (US) 04555

( * ) Notice: Subject to any disclaimer, the term of this patent is extended or adjusted under 35 U.S.C. 154(b) by 0 days.

(21) Appl. No.: 09/785,603

(22) Filed: Feb. 16, 2001

(65) Prior Publication Data

US 2002/0112591 A1 Aug. 22, 2002

(51) Int. Cl.[7] ..... G10D 3/14

(52) U.S. Cl. ..... 84/312 R; 84/297 R; 84/298; 84/307

(58) Field of Search ..... 84/312 R, 297 R, 84/298, 307

(56) References Cited

U.S. PATENT DOCUMENTS 4,175,467 A * 11/1979 Lashley ..... 84/312 P
4,589,321 A * 5/1986 Pritchard ..... 84/297 R
5,456,151 A * 10/1995 Enserink ..... 84/297 R
6,002,075 A * 12/1999 Carter ..... 84/312 P

* cited by examiner

*Primary Examiner*—Shih-Yung Hsieh
(74) *Attorney, Agent, or Firm*—Saul Epstein

(57) ABSTRACT

A string clamping and tuning mechanism for stringed instruments is disclosed. String tension, through lever action, provides the clamping force on the string to anchor the string. A screw adjusted stop causes a change in the position of the lever system to increase or decrease the tension in the string.

13 Claims, 2 Drawing Sheets

STRING CLAMPING AND TUNING SYSTEM FOR MUSICAL INSTRUMENT

BACKGROUND OF THE INVENTION

Over the years, many systems have been devised for securing and tensioning the strings of stringed musical instruments. Strings for musical instruments are usually provided with one end enlarged (as by having an attached ball or small ring), while the other end (the free end) is unfinished.

One common tuning system in use today creates tension in the strings by wrapping the free ends around tuning posts fixed at the head end of the instrument neck, which posts are turned through a worm gear arrangement to create the required tension. The ball ends of the strings pass through openings in a tail piece, through which the balls or rings cannot pass. This system, while in common use, has stability problems because the worm gear drives needed to operate the tuning posts have backlash making precise tuning difficult, and also the strings can tighten around the posts after once being tightened, detuning the instrument.

In an alternate tuning system, the ball end of the string is held in a jaw, which is threaded to accept a screw that pulls the string taut. In this kind of system, the free end of the string is held in a clamp which ordinarily requires a tool of some sort to operate. This is obviously inconvenient at any time, but particularly in the course of a performance.

The present invention permits the free end of the string to be clamped without using tools, using the tension in the string itself to provide the clamping force. In one of its aspects, the present invention also provides (in combination with the string tension actuated clamp previously mentioned) a tuning system which has greater stability than the worm gear tuning posts of the past.

Accordingly, it is an object of the present invention to provide a system for clamping the strings of a stringed musical instrument wherein the force holding the string is provided by the tension in the string itself. It is a further object of the invention to provide a stable tuning system for a stringed musical instrument combined with a clamp actuated by string tension.

SUMMARY OF THE INVENTION

The present invention utilizes the tension in a string to provide a clamping force on the string, restraining the string from slipping longitudinally (and thereby altering the tension). The clamping force is obtained by using one or more levers to convert string tension into clamping force.

The invention has application to all classes or families of stringed musical instruments, i.e., lutes (including violins), zithers, lyres, and harps. Such instruments include a plurality of strings under tension, the strings being anchored at each end. At one end of each string are means for adjusting the string tension, i.e., means for tuning the instrument.

For clarity, the structure of the musical instrument to which the invented clamping means is attached is not shown in the drawings. Nevertheless, those skilled in the art will readily appreciate how the mechanism described would be integrated into a particular instrument. The invention may be installed at either end of the string as is convenient in a particular situation.

In a first embodiment of the invention, a single simple lever (one lever associated with each string) is aligned with its axis substantially perpendicular to the direction of string pull. Each string passes over the end of its associated lever such that the force of the string pull is exerted on the lever arm, and the lever tends to turn. The lever arm opposite the point of application of string pull is arranged to pinch the string against a fixed stop, thereby anchoring the string. Excess string may be cut off.

In a second embodiment of the invention, string pull is exerted on the end of a lever as in the first. embodiment, but a second lever, pivotally connected to the first lever and bearing against a stop, is used to provide the string pinching force.

In a third embodiment of the invention, instead of bearing against a fixed stop, the second lever bears against an adjustable screw, thereby providing a means for adjusting string tension for tuning purposes.

DETAILED DESCRIPTION OF THE INVENTION

Figure 1:
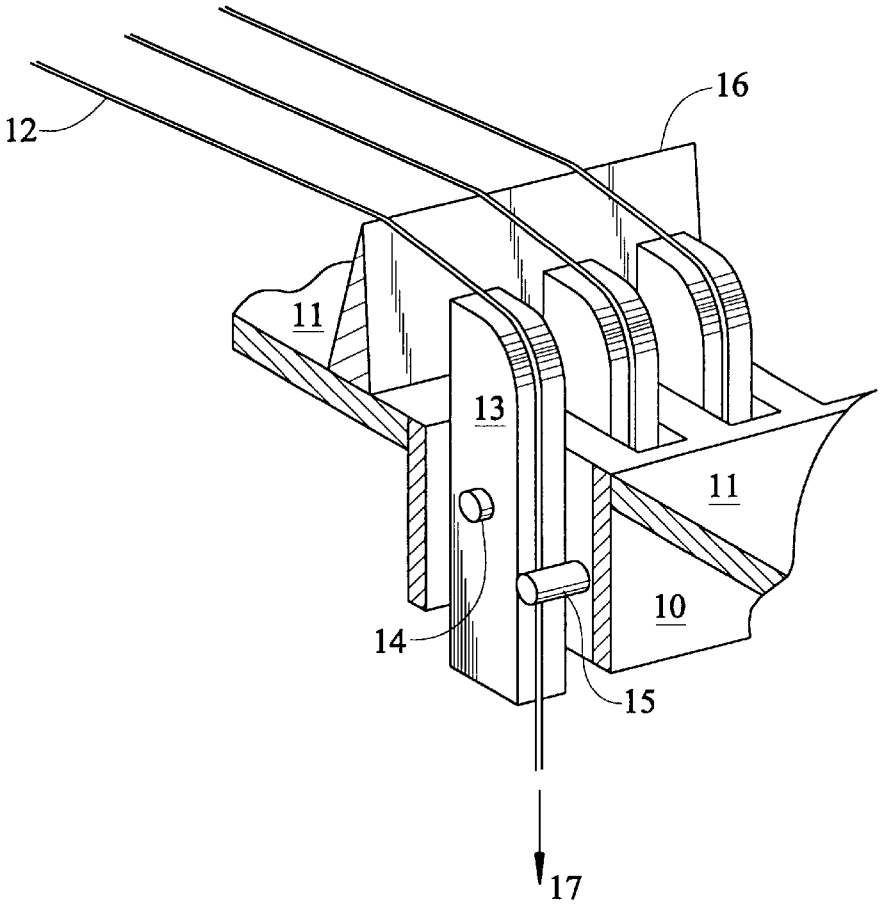
FIG. 1 is a partially sectioned trimetric view of a first embodiment of the invented system, shown installed near the tail of a stringed musical instrument.

As seen in FIG. 1, a housing 10, which supports the mechanism of a first embodiment of the invention, is set into the face 11 of a stringed musical instrument body. One end of the strings 12 are bent around the ends of levers 13, as shown, and the remote ends are anchored at an appropriate location, as will be understood by those skilled in the art. The invented mechanism may, for example, be positioned near the tail of a violin, in which case the strings preferably pass over a bridge 16, and conventional tuning mechanisms may be provided at the distal ends of the strings, i.e., at the head. Three strings are shown in the figures for illustrative purposes, but it will be understood that any number of strings may be utilized, as required by the instrument involved.

The levers 13 are rotatable about pivot pins 14, which are fixed to the housing 10. Lever rotation is limited by pinch pins 15, also fixed to the housing 10. Element 15 is called a pinch pin because the string is pinched by it against the lever 13. It will be appreciated that the "pin" 15 need not be a distinct part, but could, as well, be integral with the structure of the housing.

Assuming, for example, that rotatable tuning posts are used to tune the instrument, upon installation each string is first wrapped around a tuning post and then passed over the bridge and through the space between lever 13 and pinch pin 15. The free end of each string is then pulled taut in a generally downward direction (as denoted by the numeral 17 in FIG. 1). This motion of the string causes the lever to rotate about the pivot pin and pinch the string at pinch pin 15. Turning the tuning post to increase tension on the string then causes the pinch pressure to increase. The amount of pinch pressure relative to string tension is determined by the ratio of the lever arms, in accordance with the elementary principles of mechanics. By appropriately setting the lever arm ratio, the amount of pinch pressure may be made sufficient to prevent string slippage, while at the same time not severing the string due to excess pressure. The relevant lever arms are 1) the distance from the contact between the string and the lever 13 to the pivot pin 14, and 2) the distance between the pinch pin 15 and the pivot pin 14. The actual pinch force is influenced both by the lever arm ratio and the angle at which the pinch pin 15 presses against lever 13.

Figure 2:
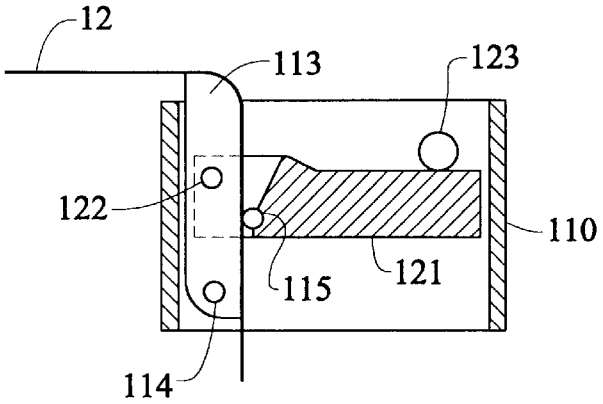
FIG. 2 is a side sectioned view of a second embodiment of the invention.

Additional mechanical advantage to pinch the string may be obtained by including a second lever, as shown in the embodiment illustrated in FIG. 2. The elements in the alternate embodiments which are substantially the same as the corresponding elements of the first embodiment described are identified with the same numeral. Elements which are similar (but not necessarily identical) in function are denoted by the same numeral plus 100.

Figure 2A:
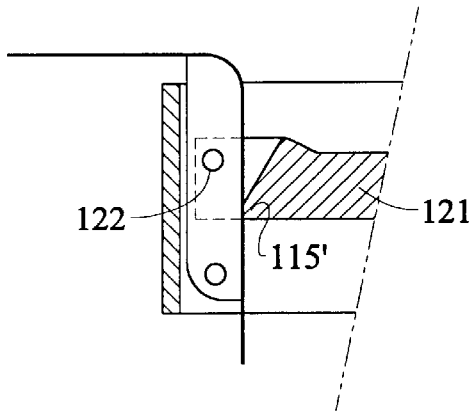
FIG. 2A is a partial side sectioned view of an alternate construction of the embodiment of FIG. 2.

Only a cross sectional view showing the details of one string mechanism is shown in FIG. 2, it being understood that the mechanism is replicated for each string of the instrument. According to the embodiment of FIG. 2, a housing 110 contains a plurality of levers 113, each corresponding to one of the strings 12 of the instrument. Each lever 113 pivots around a corresponding pivot pin 114. Additionally, a second lever 121 (which has a clevis-like shape) pivots around second pivot pin 122. The second pivot pins 122 are not attached to the housing 110, but are rather attached to the respective lever 113. Tension in string 12 causes the lever 121 to bear against stop pin 123 (which is attached to housing 110). Pinch pin 115 is therefore pressed against string 12, pinching it and preventing the string from slipping. The pinching function need not be performed by a separate part (115), but as illustrated in FIG. 2A, "pin" 115 can be integral with lever 121 (as indicated by the numeral 115')

As shown in FIG. 2, pivot pin 114 is shown positioned below pivot pin 122. This relationship is not required, however. Pivot pin 114 could, for example, be located coincident with pivot pin 122, or even above it, depending on the mechanical advantages desired in a particular case.

Figure 3:
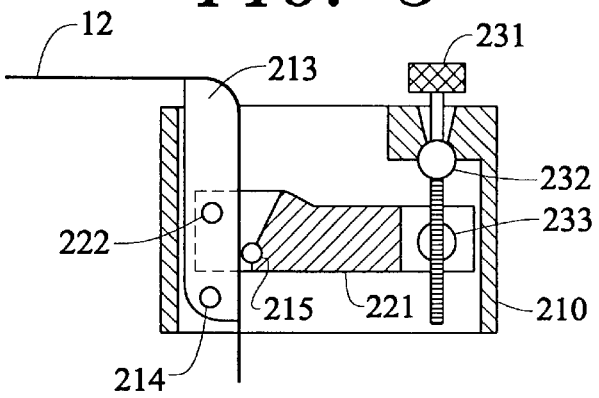
FIG. 3 is a side sectioned view of a third embodiment of the invention.

FIG. 3 illustrates an embodiment similar to that of FIG. 2, but further includes means for changing the tension in the strings for tuning purposes. In the embodiment of FIG. 3, the stop pin 123 is replaced with a threaded screw 231. A ball shaped section 232 on screw 231 engages a mating socket in housing 210, permitting the screw to exert downward force on lever 221. Screw 231 passes through a threaded pin 233 in lever 221, the threaded pin being a loose fit in the lever, so as to allow alignment of the screw as lever 221 moves. Turning the screw 231 so as to make the second lever 221 rotate clockwise (as shown in FIG. 3) will increase tension in the string. The positional relationship between pivot pins 214 and 222 can be varied in the same manner as described in connection with FIG. 2.

Figure 4:
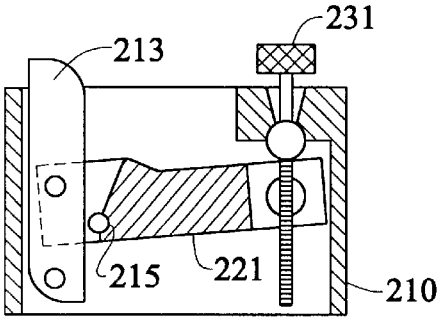
FIG. 4 is a side sectioned view of the embodiment of FIG. 3, with the clamp open to accept a string.
Figure 5:
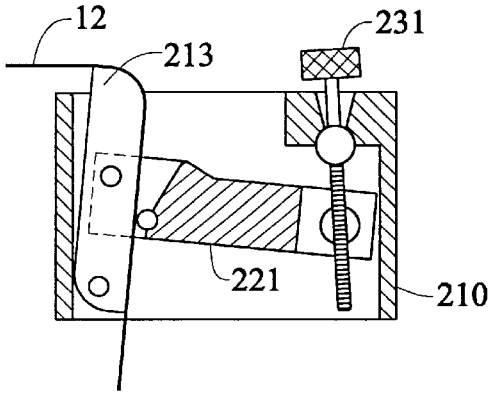
FIG. 5 is a side sectioned view of the embodiment of FIG. 3 with greater tension applied to the string.

FIGS. 4 and 5 illustrate the embodiment of FIG. 3 in various conditions. FIG. 4 shows the mechanism with the screw 231 turned to completely retract lever 221. In this condition, there is space between pinch pin 215 and lever 213 so as to permit a string to be easily threaded through the instrument. FIG. 5 shows the embodiment of FIG. 3 with even more tension applied to the string than is illustrated in FIG. 3. Screw 231 has been turned to move the lever 221 downward, thereby rotating lever 213 so as to increase tension.

Figure 6:
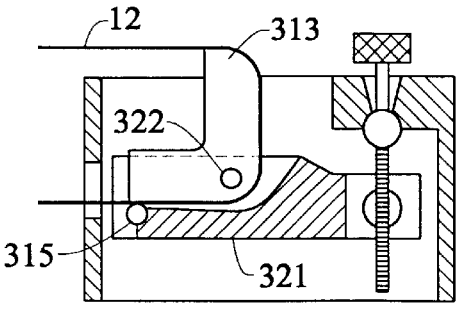
FIG. 6 is a side sectioned view of an alternate construction of the embodiment of FIG. 3.
Figure 7:
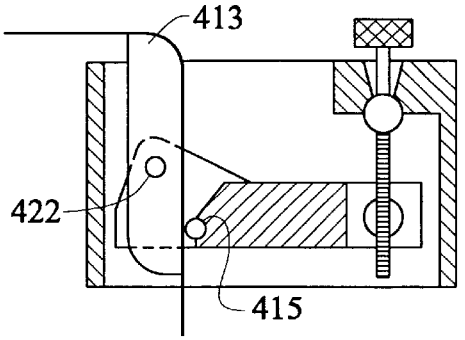
FIG. 7 is a side sectioned view of an alternate construction of the embodiment of FIG. 6.

FIGS. 6 and 7 depict further alternate constructions of the invention, and illustrate the versatility available in the locations of the pivot axes.

FIG. 6 shows an alternate construction of the embodiment of FIGS. 3–5. In this construction, the first lever 313 and the second lever 321 pivot around the same axis, pivot pin 322. The first lever 213 in the construction of FIG. 4 is shown bent and pinch pin 315 moved laterally so that the motion of pinch pin 315 is about 90° as compared to the motion of pinch pin 215 in the construction shown in FIG. 3. The lever 321 is shown bent to illustrate that so long as the desired lever ratios are obtained, the directions taken by the lever arms are not important.

FIG. 7 illustrates a variant of the embodiment illustrated in FIG. 6 wherein the lever 413 is not bent, as is the lever 313 in FIG. 6. In both the embodiments of FIGS. 6 and 7, the two levers are shown rotating about a common axis (shown as pivot pins 322 and 422). While presently preferred, it is not necessary that the axes be coincident. If desired, the pivot pins for the two levers could be carried by the housing at locations other than as shown in the figures.

Irrespective of the locations of the pivot pins, the pinching forces and the forces required to adjust the string tension may be set as desired by making the lever arms of appropriate length. The elementary principles of mechanics may be applied in making the calculations.

What has been described is a system for clamping the strings of a stringed musical instrument and for tuning the instrument Persons skilled in the art will no doubt be able to make various modifications and adaptations of the invention but yet be within the inventive teachings disclosed both explicitly and implicitly herein. The limits of the invention sought to be protected are defined by the following claims.

I claim:

1. In a stringed musical instrument of the type having at least one string stretched between anchoring points, a string anchoring system which comprises:

a first lever rotatable about an axis normal to the direction of said string and coupled to said string, tension in said string tending to cause said first lever to rotate; and string clamping means actuated by rotation of said first lever responsive to tension in said string.

2. A string anchoring system as recited in claim 1 wherein said string clamping means comprises a pinch member against which said first lever bears, said string being pinched between said lever and said pinch member.

3. A string anchoring system as recited in claim 2 wherein said pinch member is carried by a second lever, said second lever being rotatably coupled to said first lever, the rotation of said second lever being limited by a stop.

4. A string anchoring system as recited in claim 3, wherein said stop is positionally adjustable to change the tension in said string.

5. A string anchoring system as recited in claim 2 wherein said pinch member is carried by a second lever, said second lever being rotatable about an axis coincident with or parallel to the axis of rotation of said first lever, the rotation of said second lever being limited by a stop.

6. A string anchoring system as recited in claim 5, wherein said stop is positionally adjustable to change the tension in said string.

7. In a stringed musical instrument, of the type having at least one string stretched between first and second anchoring points, a string anchoring system which comprises:

a housing attached to said instrument;

a first lever coupled to said housing for rotation around an axis normal to the length of said string, said string being partially bent around said lever whereby tension in said string will tend to cause rotation of said lever;

a second lever rotatably coupled to said first lever;

a first stop attached to said second lever for limiting the motion of said second lever with respect to said first lever, said string passing between said first lever and said first stop; and a second stop attached to said housing and limiting the motion of said second lever with respect to said housing.

8. In a stringed musical instrument as recited in claim 7 wherein the position of said second stop with respect to said housing is adjustable.

9. In a stringed musical instrument as recited in claim 8 wherein said second stop is comprised of screw means threadedly coupled to said second lever and bearing against said housing.

10. In a stringed musical instrument, of the type having at least one string stretched between first and second anchoring points, a string anchoring system which comprises:

a housing attached to said instrument;

a first lever coupled to said housing for rotation around an axis normal to the length of said string, said string being partially bent around said lever whereby tension in said string will tend to cause rotation of said lever;

a second lever rotatable about an axis coincident with or parallel to the axis of rotation of said first lever;

a first stop attached to said second lever limiting the motion of said second lever with respect to said first lever, said string passing between said first lever and said first stop; and a second stop attached to said housing and limiting the motion of said second lever with respect to said housing.

11. In a stringed musical instrument as recited in claim 10 wherein the position of said second stop with respect to said housing is adjustable.

12. In a stringed musical instrument as recited in claim 11 wherein said second stop is comprised of screw means threadedly coupled to said second lever and bearing against said housing.

13. In a stringed musical instrument as recited in claim 10 wherein said axis of rotation of said second lever is fixed with respect to said housing.

* * * * *